US011527211B2

(12) United States Patent
Jo

(10) Patent No.: US 11,527,211 B2
(45) Date of Patent: Dec. 13, 2022

(54) ORGANIC LIGHT EMITTING DIODE DISPLAY DEVICE AND DRIVING METHOD OF THE SAME

(71) Applicant: LG Display Co., Ltd., Seoul (KR)

(72) Inventor: Seung-Ju Jo, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/561,277

(22) Filed: Dec. 23, 2021

(65) Prior Publication Data

US 2022/0208128 A1 Jun. 30, 2022

(30) Foreign Application Priority Data

Dec. 30, 2020 (KR) ..... 10-2020-0187272

(51) Int. Cl.
*G09G 3/3291* (2016.01)

(52) U.S. Cl.
CPC ... *G09G 3/3291* (2013.01); *G09G 2300/0828* (2013.01); *G09G 2310/0291* (2013.01); *G09G 2330/12* (2013.01)

(58) Field of Classification Search
CPC .... G09G 3/3233; G09G 3/006; G09G 3/3208; G09G 2320/0295; G09G 2320/045; G09G 2320/0233; G09G 2320/043; G09G 2320/029; G09G 2320/0693; G09G 2320/0285; G09G 2330/12; G09G 2310/0291
See application file for complete search history.

(56) References Cited

U.S. PATENT DOCUMENTS 6,259,287 B1 * 7/2001 Macks ..... H03K 17/22 327/143
2003/0146888 A1 * 8/2003 Yamazaki ..... G09G 3/3291 345/82
2009/0179832 A1 * 7/2009 Kohno ..... G09G 3/3233 345/76
2013/0162617 A1 * 6/2013 Yoon ..... G09G 3/3291 345/76
2015/0379937 A1 * 12/2015 Kim ..... G09G 3/3275 345/691
2018/0053462 A1 * 2/2018 Bae ..... G09G 3/3233

FOREIGN PATENT DOCUMENTS

KR 10-2019-0078316 A 7/2019

* cited by examiner

*Primary Examiner* — Dong Hui Liang
(74) *Attorney, Agent, or Firm* — Seed IP Law Group LLP

(57) ABSTRACT

An organic light emitting diode display device includes a display panel including a plurality of sub-pixels, each of which includes a driving thin film transistor and a light emitting diode; and an impedance detection part connected to the plurality of sub-pixels of the display panel. The impedance detection part includes a sensing circuit part, an input control part, and an analog-to-digital converter. The input control part generates a modulated output by modulating an output of the sensing circuit part and inputs the modulated output to the analog-to-digital converter.

10 Claims, 5 Drawing Sheets

ORGANIC LIGHT EMITTING DIODE DISPLAY DEVICE AND DRIVING METHOD OF THE SAME

CROSS-REFERENCE TO RELATED APPLICATION

The present application claims priority from and the benefit under 35 U.S.C § 119(a) of Korean Patent Application No. 10-2020-0187272 filed on Dec. 30, 2020, which is hereby incorporated by reference in its entirety.

BACKGROUND

Technical Field

The present disclosure relates to an organic light emitting diode display device, and more particularly, to an organic light emitting diode display device and a driving method of the same that compensate for a change in characteristics of a light emitting diode.

Description of the Related Art

Recently, flat panel display devices have been widely developed and applied to various fields because of their thin profile, light weight, and low power consumption.

As one of flat panel display devices, an organic light emitting diode display device has wide viewing angles as compared with a liquid crystal display device because it is self-luminous and also has advantages of a thin thickness, light weight and low power consumption because a backlight unit is not necessary.

In addition, the organic light emitting diode display device is driven by low voltages of direct current (DC) and has a fast response speed. Further, the organic light emitting diode display device is strong against the external impacts and is used in a wide range of temperatures because its components are solids, and particularly, the organic light emitting diode display device can be manufactured at low costs.

The organic light emitting diode display device includes a plurality of pixels, each of which has first, second and third sub-pixels including light emitting diodes emitting light of different lights, and displays various color images by allowing the first, second and third sub-pixels to selectively emit light.

By the way, in the organic light emitting diode display device, since the light emitting diode continuously emits light to display the image during each frame, the light emitting diode degrades due to driving for a long time, thereby changing the characteristics of the light emitting diode. Accordingly, even though the same data signal is applied, the luminance of each sub-pixel may vary, and a non-restored afterimage may occur.

To solve the problem, a method of detecting a change in the characteristics of the light emitting diode by measuring the impedance of the light emitting diode and reflecting the detection result to thereby compensate for the data signal has been proposed.

BRIEF SUMMARY

The inventors have realized that the analog-to-digital converter (ADC) used to measure the impedance of the light emitting diode has a limited range. In addition, each light emitting diode has differences in materials, formation conditions, element configurations, and so on depending on the color of the emitted light and also has the difference in the driving voltages.

Accordingly, it is difficult to measure the exact impedance of each light emitting diode, and thus it is difficult to measure the exact amount of degradation and compensate for the data signal.

Accordingly, the present disclosure is directed to an organic light emitting diode display device and a driving method of the same that substantially obviate one or more of the problems due to limitations and disadvantages of the related art.

A technical feature of the present disclosure is to provide an organic light emitting diode display device and a driving method of the same capable of compensating for a change in characteristics of a light emitting diode by the exact amount of degradation of each light emitting diode.

Additional features and advantages of the present disclosure will be set forth in the description which follows, and in part will be apparent from the description, or can be learned by practice of the present disclosure. The technical features and other advantages of the present disclosure will be realized and attained by the structure particularly pointed out in the written description and claims hereof as well as the appended drawings.

To achieve these and other advantages and in accordance with the purpose of the present disclosure, as embodied and broadly described herein, there is provided an organic light emitting diode display device that includes a display panel including a plurality of sub-pixels, each of which includes a driving thin film transistor and a light emitting diode, and an impedance detection part connected to the plurality of sub-pixels of the display panel. The impedance detection part includes a sensing circuit part, an input control part, and an analog-to-digital converter. The input control part generates a modulated output by modulating an output of the sensing circuit part, and inputs the modulated output to the analog-to-digital converter.

The input control part may include a modulation part having at least one Zener diode.

The input control part may further include a first operational amplifier, a second operational amplifier, and a resistor. And the modulation part may be connected between the first and second operational amplifiers, and the resistor may be connected to the modulation part and the second operational amplifier.

A non-inverting input terminal of the first operational amplifier may be connected to the output of the sensing circuit part, and an inverting input terminal of the first operational amplifier may be connected to an output terminal of the first operational amplifier. A cathode of the at least one Zener diode may be connected to the output terminal of the first operational amplifier, and an anode of the at least one Zener diode may be connected to a non-inverting input terminal of the second operational amplifier. An inverting input terminal of the second operational amplifier may be connected to an output terminal of the second operational amplifier, and the output terminal of the second operational amplifier may be connected to an input of the analog-to-digital converter. And a first end of the resistor may be connected to the anode of the at least one Zener diode and the non-inverting input terminal of the second operational amplifier, and a second end of the resistor may be connected to a ground.

The modulation part may include n Zener diodes connected in parallel and n switches connected to the n Zener diodes, respectively, and n is an integer of 2 or more.

The n Zener diodes may have different Zener voltages from each other.

In another embodiment, a method is provided for driving an organic light emitting diode display device that comprises a display panel including a plurality of sub-pixels, each of which includes a driving thin film transistor and a light emitting diode. The method includes applying a test voltage, generating a measured sensing voltage by measuring a sensing voltage corresponding to the test voltage, generating a modulated sensing voltage by modulating the measured sensing voltage, and converting the modulated sensing voltage to a sensing data.

A method of driving an organic light emitting diode display device may further comprise generating a calculated impedance by calculating an impedance from the sensing data, generating a compensation image data from the calculated impedance, and displaying an image using the compensation image data.

A method of driving an organic light emitting diode display device may further comprise comparing a measured value of the sensing voltage with an upper limit of an effective measurement range of the analog-to-digital converter between the generating a measured sensing voltage and the generating a modulated sensing voltage. The generating a modulated sensing voltage may be performed when the measured value is greater than the upper limit.

It is to be understood that both the foregoing general description and the following detailed description are by example and explanatory and are intended to provide further explanation of the present disclosure as claimed.

BRIEF DESCRIPTION OF THE SEVERAL VIEWS OF THE DRAWINGS

The accompanying drawings, which are included to provide a further understanding of the present disclosure and which are incorporated in and constitute a part of this specification, illustrate an embodiment of the present disclosure and together with the description serve to explain the principles of the present disclosure. In the drawings.

DETAILED DESCRIPTION

Reference will now be made in detail to an embodiment of the disclosure, examples of which are illustrated in the accompanying drawings.

Figure 1:
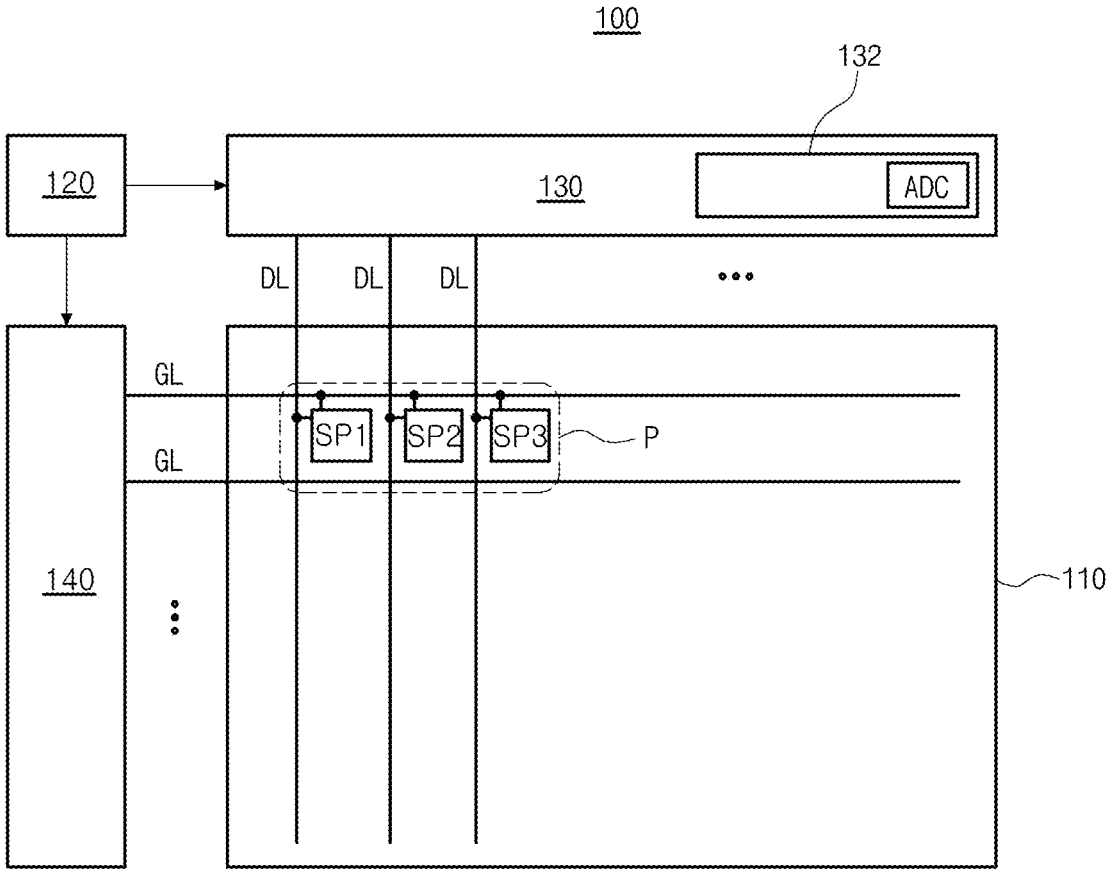
FIG. 1 is a schematic view of an organic light emitting diode display device according to an embodiment of the present disclosure.

FIG. 1 is a schematic view of an organic light emitting diode display device according to an embodiment of the present disclosure.

In FIG. 1, the organic light emitting diode display device 100 according to the embodiment of the present disclosure includes a display panel 110, a timing controlling part 120, a data driving part 130, and a gate driving part 140. The timing controlling part 120 may be or include timing controlling circuitry 120, and may be referred to as the timing controlling circuitry 120. The data driving part 130 may be or include data driving circuitry 130, and may be referred to as the data driving circuitry 130. The gate driving part 140 may be or include gate driving circuitry 140, and may be referred to as the gate driving circuitry 140.

The timing controlling part 120 generates an image data, a data control signal, and a gate control signal using an image signal and timing signals of a data enable signal, a horizontal synchronization signal, a vertical synchronization signal, and a clock transmitted from an external system (not shown) such as a graphic card or a television system. The timing controlling part 120 transmits the image data and the data control signal to the data driving part 130 and transmits the gate control signal to the gate driving part 140.

The data driving part 130 generates a data voltage of a data signal using the data control signal and the image data transmitted from the timing controlling part 120 and applies the data voltage to a data line DL of the display panel 110.

Meanwhile, the data driving part 130 includes an impedance detection part 132 having an analog-to-digital converter (ADC), and the impedance detection part 132 measures the impedance of the light emitting diode of the display panel 110 such that the amount of degradation of the light emitting diode can be detected. This will be described in detail later.

The gate driving part 140 generates a gate voltage of a gate signal using the gate control signal transmitted from the timing controlling part 120 and applies the gate voltage to a gate line GL of the display panel 110.

The gate driving part 140 may be a gate-in-panel (GIP) type where the gate driving part 140 is disposed on a substrate of the display panel 110 on which the gate line GL, the data line DL, and a pixel P are formed.

The display panel 110 displays an image using the gate voltage and the data voltage. To do this, the display panel 110 includes a plurality of pixels P, a plurality of gate lines GL, and a plurality of data lines DL, which are disposed in a display area.

Each of the plurality of pixels P includes red, green, and blue sub-pixels SP1, SP2, and SP3, and the gate lines GL and the data lines DL cross each other to define the red, green, and blue sub-pixels SP1, SP2, and SP3. For example, each of the red, green and blue sub-pixels SP1, SP2, SP3 may be located at or near a region of overlap of a respective gate line GL and a respective data line DL.

Red, green, and blue light emitting diodes are provided in the red, green, and blue sub-pixels SP1, SP2, and SP3, respectively. In addition, each of the red, green, and blue sub-pixels SP1, SP2, and SP3 can include a plurality of thin film transistors such as a switching thin film transistor and a driving thin film transistor and a storage capacitor, and this will be described in detail with reference to FIG. 2.

Figure 2:
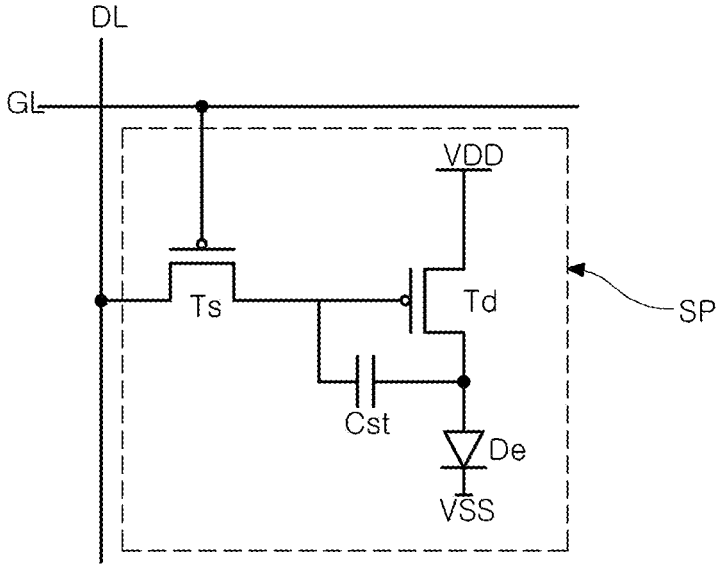
FIG. 2 is a circuit diagram of one sub-pixel of an organic light emitting diode display device according to an embodiment of the present disclosure.

FIG. 2 is a circuit diagram of one sub-pixel of an organic light emitting diode display device according to an embodiment of the present disclosure.

In FIG. 2, the organic light emitting diode display device according to the embodiment of the present disclosure includes a gate line GL and a data line DL crossing each other to define a sub-pixel SP. A switching thin film transistor Ts, a driving thin film transistor Td, a storage capacitor Cst, and a light emitting diode De are formed in each sub-pixel SP. In some embodiments, position of the sub-pixel SP may be at or near a region of overlap between the gate line GL and the data line DL shown in FIG. 2.

For example, the switching thin film transistor Ts and the driving thin film transistor Td may be P-type thin film transistors. However, the present disclosure is not limited thereto, and the switching thin film transistor Ts and the driving thin film transistor Td may be N-type thin film transistors.

More specifically, a gate electrode of the switching thin film transistor Ts is connected to the gate line GL and a source electrode of the switching thin film transistor Ts is connected to the data line DL. A gate electrode of the driving thin film transistor Td is connected to a drain electrode of the switching thin film transistor Ts and a source electrode of the driving thin film transistor Td is connected to a high voltage supply VDD. An anode of the light emitting diode De is connected to a drain electrode of the driving thin film transistor Td, and a cathode of the light emitting diode De is connected to a low voltage supply VSS. The storage capacitor Cst is connected to the gate electrode and the drain electrode of the driving thin film transistor Td.

The organic light emitting diode display device is driven to display an image. For example, when the switching thin film transistor Ts is turned on by a gate signal applied through the gate line GL, a data signal from the data line DL is applied to the gate electrode of the driving thin film transistor Td and an electrode of the storage capacitor Cst through the switching thin film transistor Ts.

When the driving thin film transistor Td is turned on by the data signal, an electric current flowing through the light emitting diode De is controlled, thereby displaying an image. The light emitting diode De emits light due to the current supplied through the driving thin film transistor Td from the high voltage supply VDD.

Namely, the amount of the current flowing through the light emitting diode De is proportional to the magnitude of the data signal, and the intensity of light emitted by the light emitting diode De is proportional to the amount of the current flowing through the light emitting diode De. Thus, the sub-pixels SP show different gray levels depending on the magnitude of the data signal, and as a result, the organic light emitting diode display device displays an image.

In addition, the storage capacitor Cst maintains charges corresponding to the data signal for a frame when the switching thin film transistor Ts is turned off. Accordingly, even if the switching thin film transistor Ts is turned off, the storage capacitor Cst allows the amount of the current flowing through the light emitting diode De to be constant and the gray level shown by the light emitting diode De to be maintained until a next frame.

Meanwhile, one or more thin film transistors and/or capacitors can be added in the pixel P region in addition to the switching and driving thin film transistors Ts and Td and the storage capacitor Cst.

As described above, the light emitting diode De of the organic light emitting diode display device may degrade due to driving for a long time. Accordingly, in order to measure the amount of degradation of the light emitting diode De and compensate for the data signal, the data driving part 130 according to the embodiment of the present disclosure includes the impedance detection part 132. The impedance detection part 132 will be described with reference to FIG. 3.

Figure 3:
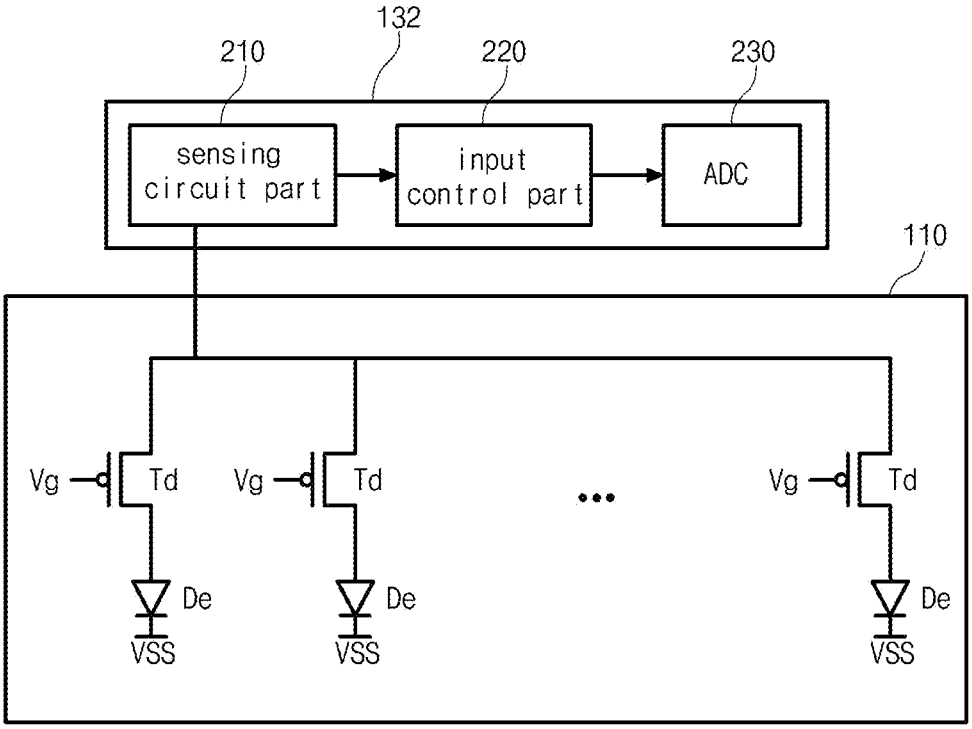
FIG. 3 is a schematic view of the display panel and the impedance detection part of the organic light emitting diode display device according to the embodiment of the present disclosure.

FIG. 3 is a schematic view of the display panel and the impedance detection part of the organic light emitting diode display device according to the embodiment of the present disclosure.

In FIG. 3, the impedance detection part 132 of the organic light emitting diode display device according to the embodiment of the present disclosure includes a sensing circuit part 210, an input control part 220, and an analog-to-digital converter (ADC) 230. The input control part 220 may be or include input control circuitry 220, and may be referred to as the input control circuitry 220.

The sensing circuit part 210 is connected to the sub-pixels of the display panel 110 to measure impedances of the light emitting diodes.

Specifically, the sensing circuit part 210 is connected to one ends of the driving thin film transistors Td of the sub-pixels, that is, the source electrodes of the driving thin film transistors Td and measures sensing voltages corresponding to the impedances of the light emitting diode De for the red, green, and blue sub-pixels. A gate voltage Vg is inputted to the gate electrodes of the driving thin film transistor Td.

The sensing circuit part 210 may include at least one transistor and/or at least one capacitor.

The input control part 220 controls the sensing voltages measured by the sensing circuit part 210 and inputs the sensing voltages to the ADC 230. Namely, the input control part 220 modulates the sensing voltages such that the controlled values of the sensing voltages are within the measurement range of the ADC, and inputs the modulated sensing voltages to the ADC 230.

The ADC 230 converts the modulated sensing voltages of the analog signals, which are input through the input control part 220, into sensing data of the digital signals and outputs the sensing data. The ADC 230 input the sensing data to the timing controlling part 120 of FIG. 1 to compensate for the data signals.

As described above, the ADC has the limited measurement range. This will be described with reference to FIG. 4.

Figure 4:
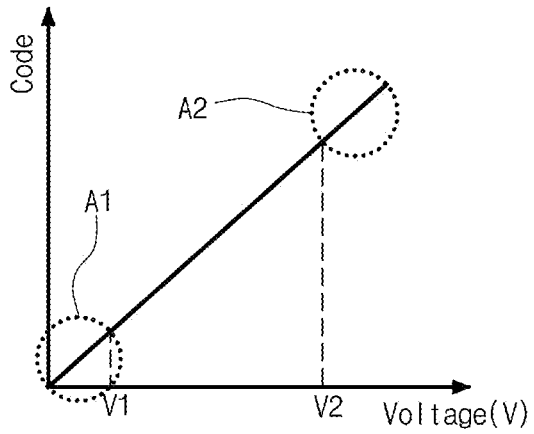
FIG. 4 is a graph showing input and output of the analog-to-digital converter.

FIG. 4 is a graph showing input and output of the analog-to-digital converter.

As shown in FIG. 4, the analog-to-digital converter (ADC) converts the input analog voltage to the digital code and then outputs the digital code.

The measurement range of the ADC is fixed, limited or selected. At this time, the lower end portion A1 and the upper end portion A2 of the measurement range are susceptible to errors, so that accurate measurement is difficult. That is, an offset error occurs at the lower end portion A1, and a gain error occurs at the upper end portion A2.

Accordingly, the ADC has an effective measurement range between the first voltage V1 and the second voltage V2 for the input value. In some embodiments, the first voltage V1 is selected to be at an upper end of the lower end portion A1, and may be a voltage at which substantially no (e.g., negligible) offset error occurs. In some embodiments, the second voltage V2 is selected to be at a lower end of the upper end portion A2, and may be a voltage at which substantially no (e.g., negligible) gain error occurs.

By the way, the red, green, and blue light emitting diodes have different driving voltages. For example, the driving voltage of the green light emitting diode may be greater than the driving voltage of the red light emitting diode and smaller than the driving voltage of the blue light emitting diode.

Thus, the impedance of the red light emitting diode may be stored through the lower end portion A1 of the measurement range of the ADC, and the impedance of the blue light emitting diode may be stored through the upper end portion A2 of the measurement range of the ADC. Since the lower end portion A1 and the upper end portion A2 are susceptible to the errors, it is difficult to accurately measure the impedances for the red, green, and blue light emitting diodes, respectively.

Accordingly, in the present disclosure, by adjusting and modulating the voltage input to the ADC 230 of FIG. 3 through the input control part 220 of FIG. 3 such that the adjusted voltage is within the effective measurement range of the ADC 230 of FIG. 3, thereby accurately measuring the impedance.

The input control part of the organic light emitting diode display device according to the embodiment of the present disclosure will be described with reference to FIG. 5.

Figure 5:
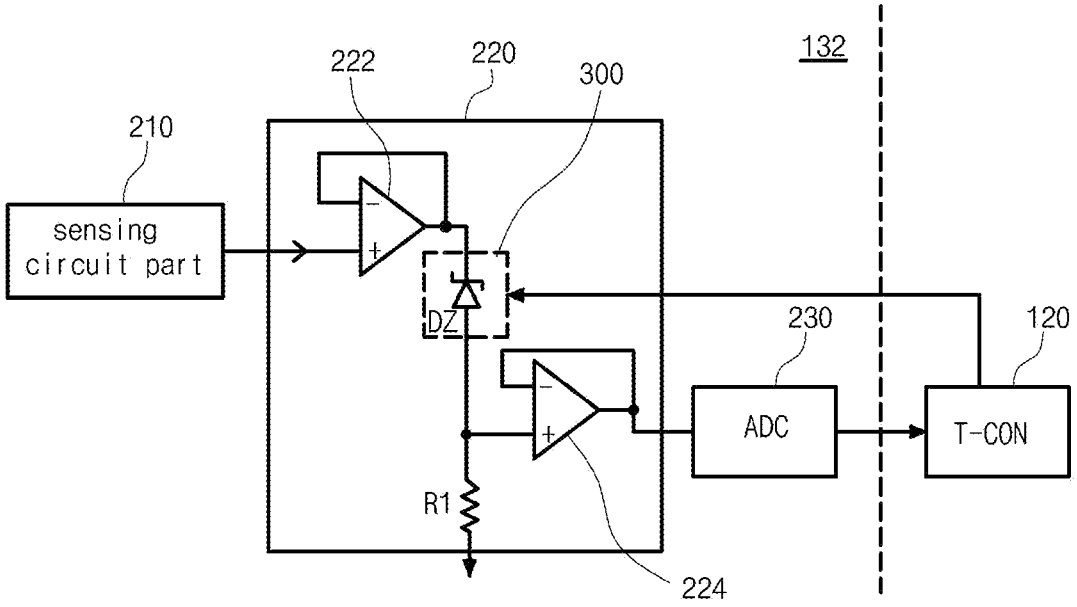
FIG. 5 is a schematic view of the input control part of the organic light emitting diode display device according to the embodiment of the present disclosure.

FIG. 5 is a schematic view of the input control part of the organic light emitting diode display device according to the embodiment of the present disclosure and shows the sensing circuit part, the analog-to-digital converter, and the timing controlling part together.

As shown in FIG. 5, in the organic light emitting diode display device according to the embodiment of the present disclosure, the input control part 220 includes a first operational amplifier 222, a second operational amplifier 224, a modulation part 300, and a resistor R1.

The non-inverting input terminal (+) of the first operational amplifier 222 is connected to the output of the sensing circuit part 210, the inverting input terminal (−) of the first operational amplifier 222 is connected to the output terminal of the first operational amplifier 222, and the output terminal of the first operational amplifier 222 is connected to the input of the modulation part 300.

The non-inverting input terminal (+) of the second operational amplifier 224 is connected to the output of the modulation part 300, the inverting input terminal (−) of the second operational amplifier 224 is connected to the output terminal of the second operational amplifier 224, and the output terminal of the second operational amplifier 224 is connected to the input of the analog-to-digital converter (ADC) 230.

The modulation part 300 modulates and outputs the input signal according to the control signal of the timing controlling part 120. At this time, the timing controlling part 120 includes a lookup table (LUT) in which a correspondence relationship between an input value and a modulation value is recorded, and the LUT may be stored in a memory. Here, the input value may be a voltage value of a signal input to the modulation part 300. Alternatively, the input value may be a value corresponding to the driving voltage of the light emitting diode, but is not limited thereto.

The modulation part 300 is connected to the output terminal of the first operational amplifier 222 and the non-inverting input terminal (+) of the second operational amplifier 224. Specifically, the input of the modulation part 300 is connected to the output terminal of the first operational amplifier 222, and the output of the modulation part 300 is connected to the non-inverting input terminal (+) of the second operational amplifier 224.

The modulation part 300 includes at least one Zener diode DZ. At this time, a cathode of the Zener diode DZ is connected to the output terminal of the first operational amplifier 222, and an anode of the Zener diode DZ is connected to the non-inverting input terminal (+) of the second operational amplifier 224.

Meanwhile, the resistor R1 has a first end connected to the output of the modulation part 300 and the non-inverting input terminal (+) of the second operation amplifier 224 and a second end connected to the ground.

In the impedance detection part 132 including the input control part 220, the sensing voltage measured by the sensing circuit part 210 is modulated through the input control part 220 to thereby be disposed within the effective measurement range of the ADC 230. At this time, the measured sensing voltage may be subtracted by the Zener voltage Vz of the Zener diode DZ of the modulation part 300. That is, the modulation value may be the Zener voltage Vz.

The modulated sensing voltage is input to the ADC 230 and converted into a sensing data of a digital signal. The sensing data is input to the timing controlling part 120, and the timing controlling part 120 compensates for the data signal using the sensing data.

The input control part 220 may modulate and output differently according to the input value. Namely, as described above, since the driving voltages of the red, green, and blue light emitting diodes are different from each other, the sensing voltages measured respectively corresponding to the red, green, and blue light emitting diodes may be different from each other. Thus, each of the sensing voltages should be modulated differently to fall within the effective measurement range of the ADC. To do this, the modulation part 300 is set to reflect different modulation values according to the input values, and this will be described with reference to FIG. 6.

Figure 6:
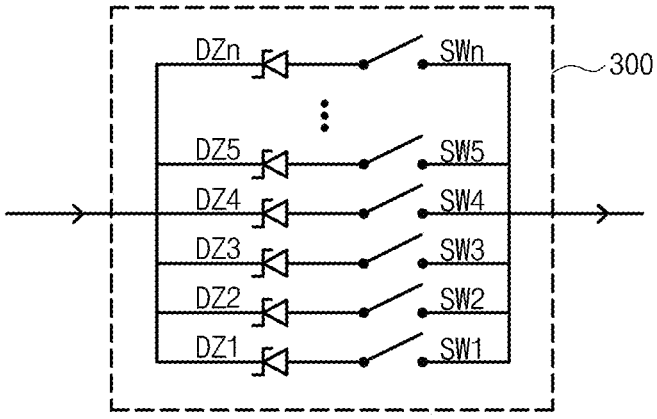
FIG. 6 is a schematic view of the modulation part of the organic light emitting diode display device according to the embodiment of the present disclosure.

FIG. 6 is a schematic view of the modulation part of the organic light emitting diode display device according to the embodiment of the present disclosure.

As shown in FIG. 6, the modulation part 300 of the organic light emitting diode display device according to the embodiment of the present disclosure includes n Zener diodes DZn. Here, n is an integer.

In the modulation part 300, when n is 2 or more, that is, when a plurality of Zener diodes DZn is provided, the plurality of Zener diodes DZn is connected in parallel.

In addition, the modulation part 300 further includes a plurality of switches SWn connected to the plurality of Zener diodes DZn, respectively, and selects the Zener diode DZn corresponding to the predetermined modulation value or selected modulation value.

The plurality of Zener diodes DZn has different breakdown voltages, that is, Zener voltages Vz. At this time, the differences between the Zener voltages Vz of the first to nth Zener diodes DZ1 to DZn may be constant. Namely, the difference between the Zener voltages Vz of the adjacent Zener diodes DZn may be the same.

Alternatively, the differences between the Zener voltages Vz of the first to nth Zener diodes DZ1 to DZn may be different. For example, the differences between the Zener voltages Vz may increase from the first Zener diode DZ1 to the nth Zener diode DZn. Alternatively, the differences between the Zener voltages Vz may decrease from the first Zener diode DZ1 to the nth Zener diode DZn.

In the modulation part 300 according to the embodiment of the present disclosure, the switches SWn connected to the Zener diodes DZn are selectively turned on, thereby differently modulating and outputting the input sensing voltages through the Zener voltages DZn of the Zener diodes DZn connected to the turned-on switches SWn.

Figure 7A:
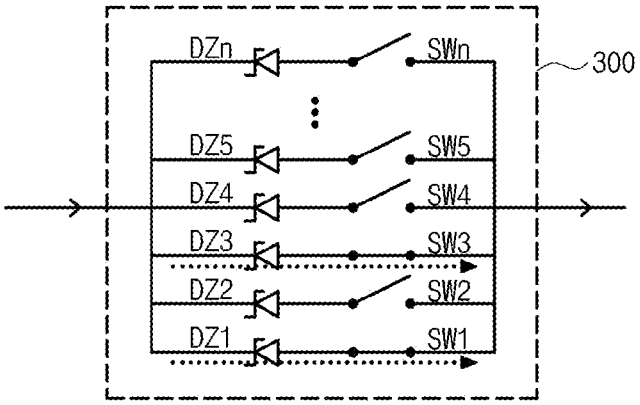
FIGS. 7A to 7C are views showing the operations of the modulation part according to the input values in the organic light emitting diode display device according to the embodiment of the present disclosure.
Figure 7B:
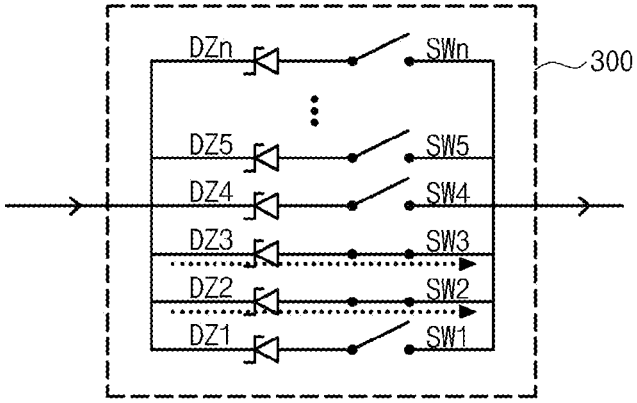
Figure 7C:
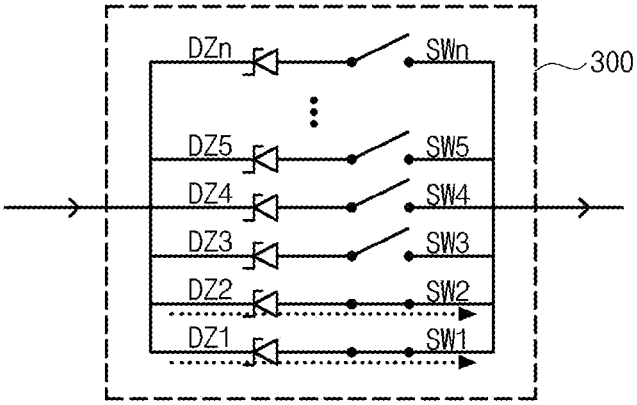

FIGS. 7A to 7C are views showing the operations of the modulation part according to the input values in the organic light emitting diode display device according to the embodiment of the present disclosure. For example, FIG. 7A, FIG. 7B, and FIG. 7C show the settings corresponding to the modulation values when the impedances of the red, green, and blue light emitting diodes are detected, respectively.

As shown in FIG. 7A, when the impedance of the red light emitting diode is detected, the first and third switches SW1 and SW3 of the modulation part 300 are turned on, and the input sensing voltage is modulated and output by the first and third Zener diodes DZ1 and DZ3.

For example, the modulation value may be 4.0 V, and the input sensing voltage is output by being subtracted by −4.0 V.

Next, as shown in FIG. 7B, when the impedance of the green light emitting diode is detected, the second and third switches SW2 and SW3 of the modulation part 300 are turned on, and the input sensing voltage is modulated and output by the second and third Zener diodes DZ2 and DZ3.

For example, the modulation value may be 5.5 V, and the input sensing voltage is output by being subtracted by −5.5 V.

Next, as shown in FIG. 7C, when the impedance of the blue light emitting diode is detected, the first and second switches SW1 and SW2 of the modulation part 300 are turned on, and the input sensing voltage is modulated and output by the first and second Zener diodes DZ1 and DZ2.

For example, the modulation value may be 3.0 V, and the input sensing voltage is output by being subtracted by −3.0 V.

However, in the present disclosure, the modulation value of the modulation part 300 is not limited thereto. The modulation value may be varied according to the design of the Zener diodes DZn, and various modulation values may be implemented by adjusting the Zener voltages Vz and numbers of the Zener diodes DZn.

At this time, each modulation value can be implemented by one Zener diode DZn.

As described above, in the present disclosure, by providing the modulation part 300 including the plurality of Zener diodes DZn, any input value can be modulated within the effective measurement range of the ADC, so that the organic light emitting diode display device can be used in various environments and the impedance of the light emitting diode can be accurately measured.

A method of driving the organic light emitting diode display device including the input control part of the present disclosure will be described with reference to FIG. 8.

Figure 8:
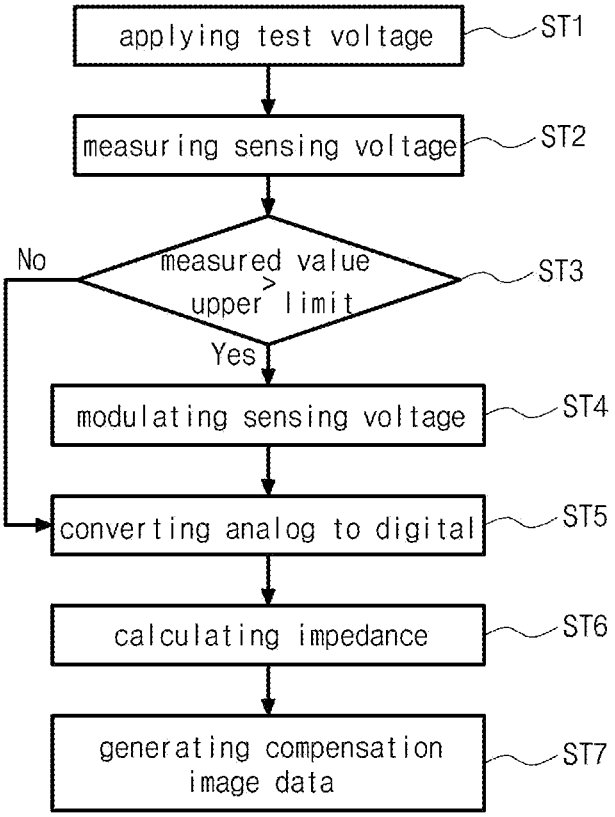
FIG. 8 is a flowchart of a method of driving the organic light emitting diode display device according to the embodiment of the present disclosure.

FIG. 8 is a flowchart of a method of driving the organic light emitting diode display device according to the embodiment of the present disclosure, and FIG. 3 is referenced together.

As shown in FIG. 8, at the first step ST1, a test voltage for measuring the impedance of the light emitting diode De is applied to the display panel 110. The test voltage may have a value corresponding to the driving voltage of the light emitting diode De. Alternatively, the test voltage may have a different value from the driving voltage of the light emitting diode De.

Next, at the second step ST2, a sensing voltage for calculating the impedance corresponding to the test voltage is measured through the sensing circuit part 210.

Next, at the third step ST3, the measured value of the measured sensing voltage is compared with the upper limit of the effective measurement range of the ADC 230. At this time, when the measured value is greater than the upper limit, the fourth step ST4 is performed to modulate the measured sensing voltage through the modulation part 300 and output the modulated sensing voltage to the ADC 230.

On the other hand, when the measured value is not greater than the upper limit, that is, the measured value is equal to or smaller than the upper limit, the measured sensing voltage is output to the ADC 230 as it is.

Next, at the fifth step ST5, the sensing voltage of the analog signal is converted to the sensing data of the digital signal through the ADC 230.

Next, at the sixth step ST6, the impedance of the light emitting diode De is calculated from the sensing data.

Next, at the seventh step ST7, the compensation image data is generated based on the calculated impedance.

Then, an image is displayed using the compensation image data.

The first to seventh steps ST1 to ST7 are performed for each of the red, green, and blue light emitting diodes De.

As described above, in the present disclosure, even when the ADC 230 having the limited measurement range is used, by adjusting the signal input to the ADC 230, the impedances of the red, green, and blue light emitting diodes De can be accurately measured, thereby compensating for the data signal, and the image quality can be improved.

In the present disclosure, by adjusting the input of the analog-to-digital converter, the impedances of the different light emitting diodes can be accurately measured even when the analog-to-digital converter having the limited measurement range is used.

In addition, any input value can be adjusted to be within the effective measurement range of the analog-to-digital converter, so that the organic light emitting diode display device can be used in various environments.

Accordingly, by accurately measuring the amount of degradation of the light emitting diode, the compensation performance can be improved, and the image quality of the display device can be improved.

It will be apparent to those skilled in the art that various modifications and variations can be made in a device of the present disclosure without departing from the sprit or scope of the embodiments. Thus, it is intended that the present disclosure covers the modifications and variations of this disclosure provided they come within the scope of the appended claims and their equivalents.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A method of driving an organic light emitting diode display device that comprises a display panel including a plurality of sub-pixels, each of which includes a driving thin film transistor and a light emitting diode, the method comprising:

applying a test voltage;

generating a measured sensing voltage by measuring a sensing voltage corresponding to the test voltage;

generating a modulated sensing voltage by modulating the measured sensing voltage; and converting the modulated sensing voltage to a sensing data, wherein the generating a modulated sensing voltage is performed by an input control circuit part, wherein the input control circuit part includes a modulation circuit part having at least one Zener diode, the input control circuit part further including a first operational amplifier, a second operational amplifier, and a resistor, and wherein the modulation circuit part is connected between the first and second operational amplifiers, and the resistor is connected to the modulation circuit part and the second operational amplifier.

2. The method of claim 1, wherein a non-inverting input terminal of the first operational amplifier is connected to an output of a sensing circuit part, and an inverting input terminal of the first operational amplifier is connected to an output terminal of the first operational amplifier, wherein a cathode of the at least one Zener diode is connected to the output terminal of the first operational amplifier, and an anode of the at least one Zener diode is connected to a non-inverting input terminal of the second operational amplifier, wherein an inverting input terminal of the second operational amplifier is connected to an output terminal of the second operational amplifier, and the output terminal of the second operational amplifier is connected to an input of an analog-to-digital converter, and wherein a first end of the resistor is connected to the anode of the at least one Zener diode and the non-inverting input terminal of the second operational amplifier, and a second end of the resistor is connected to a ground.

3. The method of claim 2, wherein the modulation circuit part includes n Zener diodes connected in parallel and n switches connected to the n Zener diodes, respectively, and n is an integer of 2 or more.

4. The method of claim 3, wherein the n Zener diodes have different Zener voltages from each other.

5. The method of claim 1, further comprising:

generating a calculated impedance by calculating an impedance from the sensing data;

generating a compensation image data from the calculated impedance; and displaying an image using the compensation image data.

6. The method of claim 1, further comprising comparing a measured value of the sensing voltage with an upper limit of an effective measurement range of an analog-to-digital converter between the generating a measured sensing voltage and the generating a modulated sensing voltage, wherein the generating a modulated sensing voltage is performed when the measured value is greater than the upper limit.

7. An organic light emitting diode display device comprising:

a display panel including a plurality of sub-pixels, each of which includes a driving thin film transistor and a light emitting diode; and an impedance detection circuit part connected to the plurality of sub-pixels of the display panel, wherein the impedance detection circuit includes a sensing circuit part, an input control circuit part, and an analog-to-digital converter, wherein the input control circuit part generates a modulated output by modulating an output of the sensing circuit part, and inputs the modulated output to the analog-to-digital converter, wherein the input control circuit part includes a modulation circuit part having at least one Zener diode, wherein the input control circuit part further includes a first operational amplifier, a second operational amplifier, and a resistor, and wherein the modulation circuit part is connected between the first and second operational amplifiers, and the resistor is connected to the modulation circuit part and the second operational amplifier.

8. The organic light emitting diode display device of claim 7, wherein a non-inverting input terminal of the first operational amplifier is connected to the output of the sensing circuit part, and an inverting input terminal of the first operational amplifier is connected to an output terminal of the first operational amplifier, wherein a cathode of the at least one Zener diode is connected to the output terminal of the first operational amplifier, and an anode of the at least one Zener diode is connected to a non-inverting input terminal of the second operational amplifier, wherein an inverting input terminal of the second operational amplifier is connected to an output terminal of the second operational amplifier, and the output terminal of the second operational amplifier is connected to an input of the analog-to-digital converter, and wherein a first end of the resistor is connected to the anode of the at least one Zener diode and the non-inverting input terminal of the second operational amplifier, and a second end of the resistor is connected to a ground.

9. The organic light emitting diode display device of claim 8, wherein the modulation circuit part includes n Zener diodes connected in parallel and n switches connected to the n Zener diodes, respectively, and n is an integer of 2 or more.

10. The organic light emitting diode display device of claim 9, wherein the n Zener diodes have different Zener voltages from each other.

* * * * *